US006820783B2

(12) United States Patent
Beale

(10) Patent No.: US 6,820,783 B2
(45) Date of Patent: Nov. 23, 2004

(54) BACK SUPPORT APPARATUS FOR USE WITH A BACKPACK

(76) Inventor: Ronald L. Beale, 7301 Middlesbury Ridge, West Hills, CA (US) 91307

( * ) Notice: Subject to any disclaimer, the term of this patent is extended or adjusted under 35 U.S.C. 154(b) by 0 days.

(21) Appl. No.: 09/844,047

(22) Filed: Apr. 30, 2001

(65) Prior Publication Data

US 2002/0158097 A1 Oct. 31, 2002

(51) Int. Cl.[7] ..... A45F 3/04
(52) U.S. Cl. ..... 224/644; 224/642; 224/907
(58) Field of Search ..... 224/644, 642, 224/907

(56) References Cited

U.S. PATENT DOCUMENTS 3,679,108 A * 7/1972 Ingram ..... 224/644
4,384,602 A 5/1983 Ores
4,420,103 A 12/1983 Douglass
5,547,461 A 8/1996 Levis
5,704,904 A 1/1998 Dunfee
6,109,495 A * 8/2000 Hernandez ..... 224/264
6,168,056 B1 * 1/2001 Bertholon ..... 224/264

FOREIGN PATENT DOCUMENTS

AU DT 2754061 * 6/1976 ..... 224/907

* cited by examiner

*Primary Examiner*—Lee Young
*Assistant Examiner*—Maerena Brevard
(74) *Attorney, Agent, or Firm*—Edgar W. Averill, Jr.

(57) ABSTRACT

A back support apparatus having a pair of elongated, inflatable bladders which are spaced parallel to each other. The pair of bladders are vertically attached to a front panel of a backpack such that when the bladders are inflated by a pump, the user may experience cushioned back support on opposite sides of the user's spinal column, especially along the thoracic region.

6 Claims, 3 Drawing Sheets

BACK SUPPORT APPARATUS FOR USE WITH A BACKPACK

BACKGROUND OF THE INVENTION

The field of the invention pertains to back support devices. The invention relates more particularly to a back support apparatus for use with a backpack, wherein the back support apparatus has a pair of parallel air bladders which supportively cushions the backpack against at least the thoracic region of a user's back in vertical alignment with and on opposite sides of the user's spinal column.

It is popularly known that backpacks are a convenient means for carrying various articles on a user's back. While backpack designs may vary depending on use, such as for school, hiking, recreation, and other applications, they all share a common basic construction in which a pair of shoulder straps are used to transfer much of the weight of the backpack against a user's back. The resulting abutting relation of the backpack against the back and spinal column, however, can often cause backache, pain and fatigue, especially if a heavily-laden backpack is carried over a period of time.

One of the areas of the back most affected by this abutting relation is the thoracic region of the back and spinal column. As can be seen in FIG. 7 of the drawings, the spinal column's S-shaped configuration causes the backpack to rest predominantly against the thoracic region when worn. Moreover, the S-shaped curvature of the spinal column can produce uneven load distributions and contact pressures within the thoracic region itself. This is especially true when rigid flat objects such as books and folders are carried in the backpack. The substantially tangential contact produced between the front panel (12 in FIG. 1) and the user's back can concentrate load pressures on focal points and areas of the backbone which can pinch, stretch, or compress nerve roots. This can cause serious health problems such as nerve, osseous, musculature, or ligamentous deterioration or damage to the affected areas of the spine.

In an effort to improve comfort and reduce back-related pains and injuries when carrying backpacks, various devices have been developed for use with backpacks to provide support to specific target regions of a user's back. For example, in U.S. Pat. No. 5,547,461 an inflatable lumbar support for a backpack is shown where a pocket is built into the lumbar region of a backpack waist belt. An inflatable and removable bladder is inserted into the lumber pocket for inflation by a hose connected to a hand pump. This device targets the lumbar region by using the inflatable bladder to fill the lumbar void and thus provide additional support thereto. However, it does not address the problems associated with the backpack-contacting areas of the thoracic region of the back and spinal column, and the need to relieve the loads and abutment pressures exerted thereon, especially when wearing or carrying a heavy-laden backpack.

Additionally, in U.S. Pat. No. 4,420,103 a backpack is shown having an integral frame formed of plastic sheets without metal supports. In particular, a support pad is mounted on the front face of the backpack, with the support pad comprising a foam sheet, a stiffener sheet, and a protective sheet. While the foam sheet is positioned adjacent a user's back to cushion the backpack load, the ability of the support pad to flex completely and fully contour to the S-shape of the spinal column may be limited by the stiffener sheet. Instead, much of the support pad's ability to conform to the S-shape of the spinal column is provided by the pivoting action of the upper and lower sections best shown in FIG. 5.

In summary, therefore, there is an unmet need for a back support device particularly designed to address the problems caused and aggravated by the abutting relationship of the backpack to the thoracic region of the back. Such a device should be ergonomically designed to conform and contour to the particular S-shape and static and dynamic characteristics of the human spinal column in order to minimize and/or reduce the occurrence of fatigue, backaches, and other back-related health problems.

BRIEF SUMMARY OF THE INVENTION

Thus, it is an object of the present invention to provide a back support apparatus for use with a backpack such that at least a thoracic region of a user's back is contouredly supported when the user wears the backpack.

It is a further object of the present invention to provide an inflatable back support apparatus for use with a backpack which vertically aligns with the user's spinal column on opposite sides thereof to provide cushioned and contoured support to at least the thoracic region of the user's back when the user wears the backpack.

It is a still further object of the present invention to provide a back support apparatus having multiple inflatable chambers such that one section or area of the back may be supported differently from other area, as per the unique needs of the user.

A still further object of the present invention is to provide a simple and cost effective back support apparatus for use with a backpack having a minimal number of parts and which may be easily manufactured using conventional manufacturing methods.

The present invention is for a back support apparatus for use with a backpack. The back support apparatus comprises a pair of elongated, inflatable bladders which are spaced generally parallel to each other. The pair of elongated, inflatable bladders are adapted to be vertically connected to a front panel of the backpack. The vertical placement on the front panel of the backpack is to provide cushioned back support on opposite sides of a user's spinal column when the backpack is carried on a user's back. More particularly, the pair of elongated, inflatable bladders are connected to the front panel of the backpack to target at least the thoracic region of the user's back. Furthermore, the back support apparatus also comprises pump means for inflating the pair of bladders, and valve means for deflating the pair of bladders. The pump and valve means are preferably a hand pump having a flexible bulb configuration with a air release valve connected thereto.

BRIEF DESCRIPTION OF THE DRAWINGS

FIG. 7 illustrates the placement of the back support apparatus with respect to the user's spinal column, especially the thoracic region.

DESCRIPTION OF THE PREFERRED EMBODIMENTS

Figure 1:
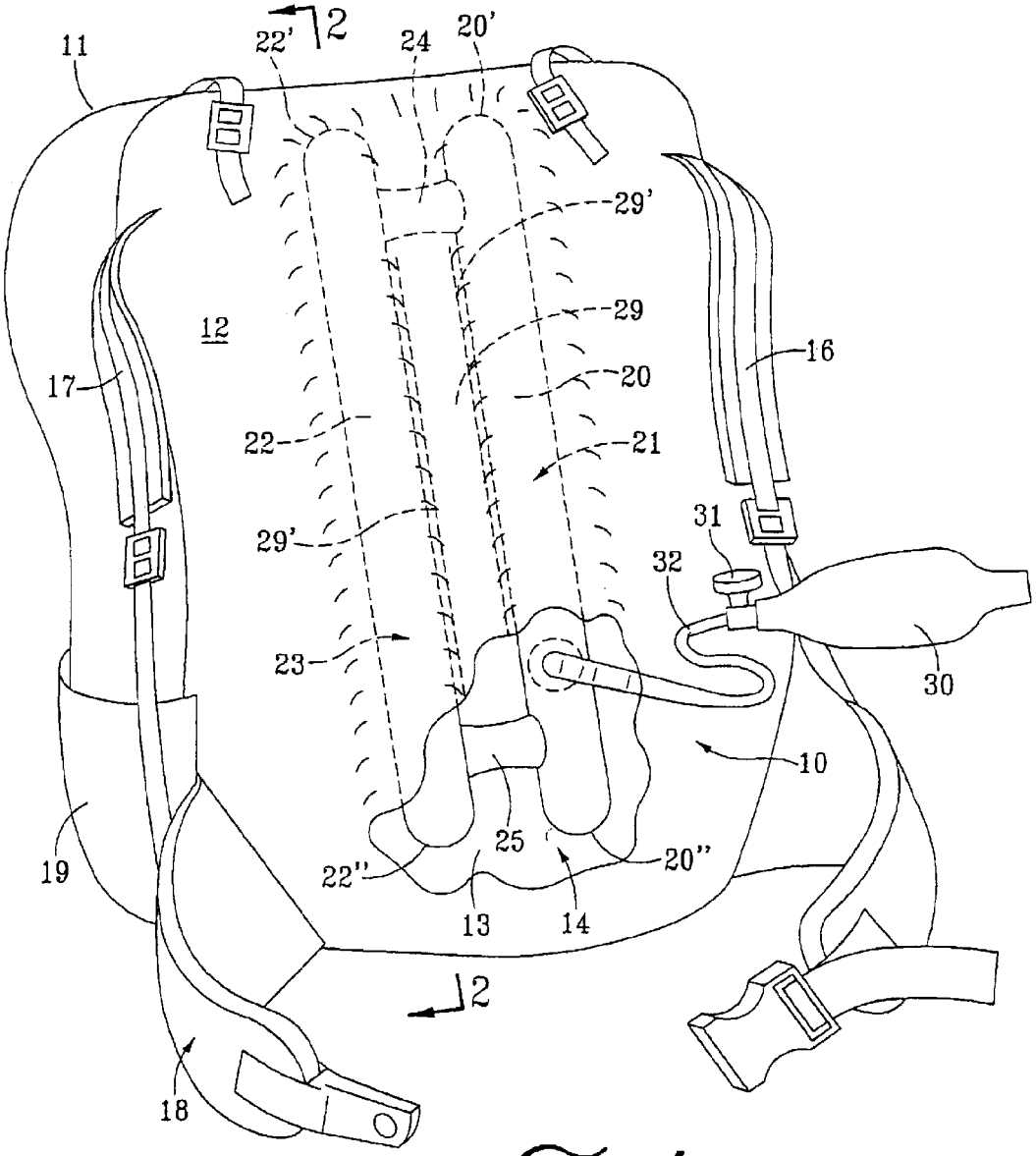
FIG. 1 is a partially broken front perspective view of a backpack incorporating the back support apparatus which is positioned inside a front panel pocket of the backpack.

Referring now to the drawings, FIGS. 1-7 show the back support apparatus, generally indicated by reference character 10. FIG. 1, in particular, is a front perspective view of the back support apparatus 10 mounted on a backpack, generally indicated by reference character 11. The backpack 11 shown in the drawings has a typical backpack construction with certain features common to all backpacks. As can be seen, the backpack 11 has a front panel 12 which faces a user's back when worn, and left and right shoulder straps 16 and 17, respectively, by which the backpack 11 is carried over a user's shoulders. Optionally, backpacks may include a waist belt 18 for securing around a user's waist for added security. Backpacks are typically constructed of a durable material, such as nylon, leather, or other material with strong, wear resistant qualities to withstand the rigors of use.

It is notable that while the term "backpack" is commonly understood to define a carrying apparatus of the type described above and typically used by students to carry books and by outdoor recreationalists when hiking or mountain climbing, it is not limited only to such. The term "backpack," as used herein and in the claims, broadly includes any and all parcels or objects which, when carried by a user, rests against the user's back. Furthermore, the term "front panel" is defined herein and in the claims to mean that side of the backpack or object adjacent to and facing the back of a user when carried or worn.

Figure 6:
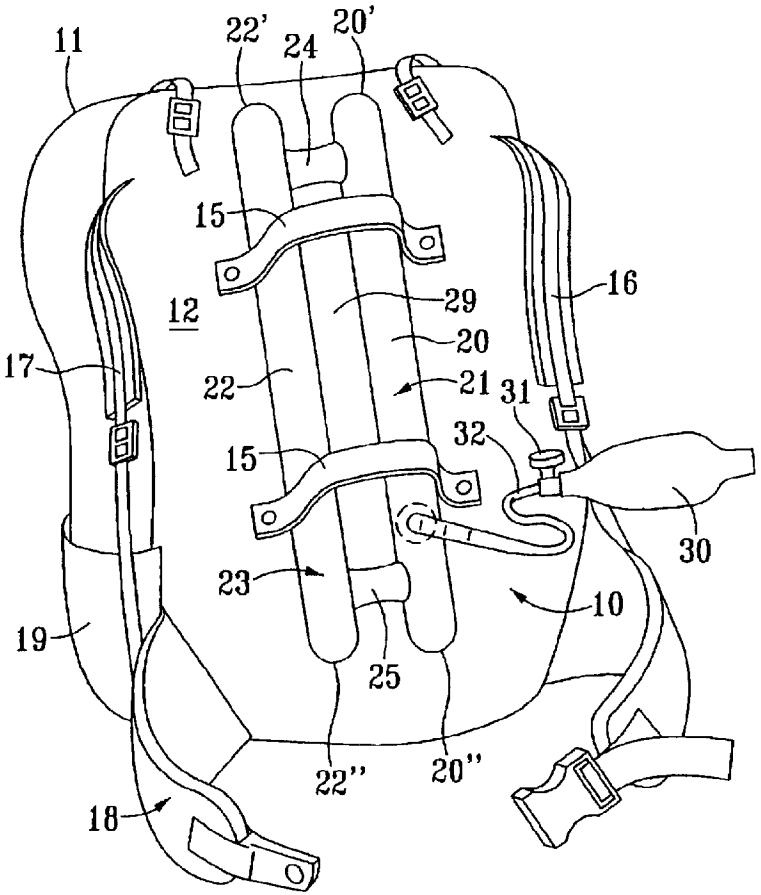
FIG. 6 is a front perspective view of a backpack with the back support apparatus attached along the outer surface of the backpack.

As can be seen in FIGS. 1 and 6, the back support apparatus 10 comprises a pair of inflatable bladders 20, 22 which surround and define inflation chambers 21, 23, respectively. The bladders 20, 22 are generally oriented parallel to each other and are vertically connected to the front panel 12 of the backpack 11. The parallel bladders 20, 22 are preferably spaced a distance of at most 2 inches from each other to accommodate the spinal column therebetween, as will be discussed in detail below. However, other separation distances between the two bladders 20, 22 may be suitably utilized as well. And preferably each bladder 20, 22 has an inflated diameter of 2 inches, which has been found by applicant to be effective in providing a comfortable degree of cushioned support without being overly obtrusive during use.

In one preferred embodiment, the two bladders 20 and 22 are preferably connected by at least one bridge conduit which enables air to communicate between the respective inflation chambers. As shown in FIGS. 1 and 6, the top end 22' of the right bladder 22 is communicably connected to a top end 20' of the left bladder 20 by means of a top bridge conduit 24. Likewise, the bottom end 22" of the right bladder 22 is also shown communicably connected to the bottom end 20" of the left bladder 20 by means of a bottom bridge conduit 25. In the embodiment shown in FIGS. 1 and 6, the top and bottom bridge conduits 24, 25 operate together to equalize pressure between the two inflation chambers 21, 23. However, bridge conduits may alternatively operate independent of each other when independent support sections are provided in a multiple support section arrangement, as will be discussed in detail below. It is notable that the inflated diameters of the bridge conduits are preferably less than the inflated diameters of the elongated bladders 20, 22 such that contact by the bladders 20, 22 to the user's back is ensured. Furthermore, the bladders 20, 22 preferably have a flexible construction suitable for containing compressed air; construction may be from, for example, an elastomeric or polymeric material. Additionally, the bridge conduits are preferably integrally constructed together with the bladders.

As can be seen in FIGS. 1 and 6, a pump 30 is provided for generally inflating the bladders 20, 22. The pump 30 is preferably a hand-held and hand-operated pump having a flexible bulb-shaped configuration which resiliently biases when squeezed to effect pumping. However, it is also contemplated that other types of pumps may be utilized, such as a battery-operated pump for automatic inflation. Furthermore, the pump 30 is connected to a suitable location on the pair of bladders 20, 22 by means of an inflation tube 32 preferably having an elastomeric construction. It is notable that the inflation tube 32 may be connected to the back support apparatus 10 at a suitable location. For example, the inflation tube 32 may be connected to either the left 20 or right 22 bladders, or either of the bridge conduits 24, 25. Preferably, the inflation tube 32 is sufficiently long to enable a user to conveniently reach and operate the pump 30. And as can be best seen in FIGS. 7, the pump 30 may be conveniently stored in a side pocket 19 of the backpack 11 for convenient access. Furthermore, the back support apparatus also comprises an air release valve 31 for deflating the bladders 20, 22. As shown in FIGS. 1 and 6, the air release valve 31 is preferably connected to the inflation tube 32 as part of the pump 30.

Figure 2:
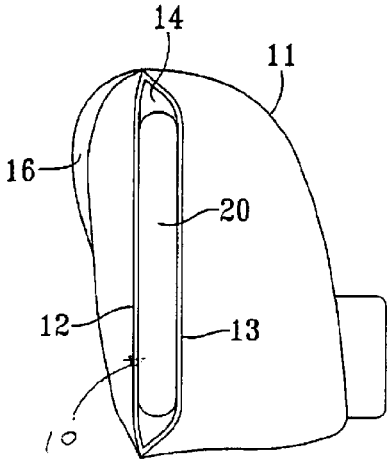
FIG. 2 is a cross-sectional side view taken along line 2—2 of FIG. 1.

Generally, the pair of elongated bladders 20, 22 are vertically and centrally connected to the front panel 12 of the backpack 11 to effect cushioned and contoured support to a user's back. In particular, as can be seen in FIGS. 1 and 2, the pair of elongated, inflatable bladders 20, 22 are preferably retainably received and secured within an interstitial pocket volume 14 formed between the front panel 12 and a pocket wall 13. As shown in FIGS. 1 and 2, the pocket wall 13 is preferably located at an interior location of the backpack relative to the front panel 12, such that it is the front panel 12 which comes in contact with the user's back. Alternatively, the pocket wall 13 may be positioned outside relative to the front panel 12 such that the pocket wall 13 may come in contact with the user's back. However, the actual positions of the front panel 12 and the pocket wall 13 relative to each other are inconsequential, so long as they serve to secure the pair of elongated bladders therein. It is also notable that the pocket wall 13 is preferably connected to the front wall 12 by being sewn or stitched together, or by other suitable means. The intersticial volume 14 thus formed may be completely enclosed whereby the pair of bladders 20, 22 may not be accessed or removed. Alternatively a pocket opening (not shown) may be provided through which said pair of bladders 20, 22 may be removably inserted into the intersticial volume 14.

The pair of elongated bladders 20, 22 may alternatively be mounted to the front panel 12 of the backpack 11 without the formation of an intersticial pocket volume 13. In this regard, another preferred embodiment is shown in FIG. 6 utilizing securing straps 15 such that the elongated, inflatable bladders 20, 22 may be attached to an outer surface of the front panel 12. Thus the bladders may directly contact the user's back to effectuate cushioned support.

Figure 7:
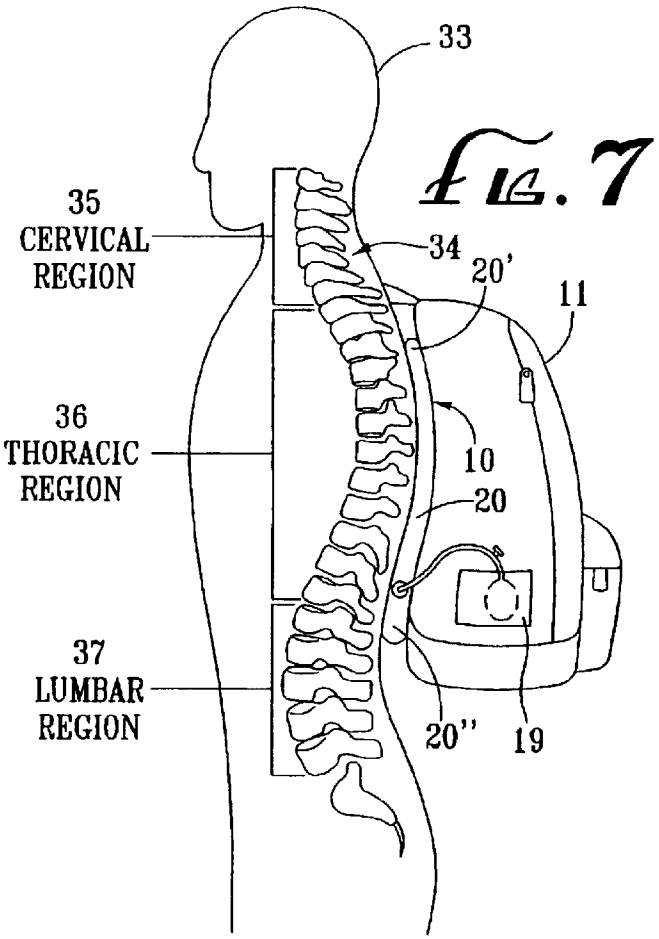
FIG. 7 is a schematic side view of the backpack and back support apparatus when worn and carried by a user.

In this manner, and regardless of the manner of attachment, the pair of elongated, parallel bladders 20, 22 are vertically and centrally positioned on the front panel 12 of the backpack 11 to vertically align with a user's spinal column (34 in FIG. 7) when the backpack 11 is worn. Generally, the bladders 20, 22 may be sufficiently spaced from each other to exert a support force against the user's spinal column 34 from opposite sides of the spinal column 34. However, as discussed above, the bladders 20, 22 are preferably spaced apart a distance of at most 2 inches, to enable the targeting of muscles surrounding and immediately anchored to the spinal column 34. As can be best seen in FIG. 7, placement of the elongated, inflatable bladders 20, 22 along the front panel is such that the bladders 20, 22 contouredly abut against at least the thoracic region 36 of the user's spinal column 34. It is notable however, that the length of the bladders 20, 22 may be further elongated to extend into the cervical and lumbar regions of the back and spinal column as well to provide even greater back support. In this manner, the pair of bladders 20, 22 operate to provide a fully-contoured and supportive intermediate cushion between the backpack 11 and at least the thoracic region 36 of the back and spinal column 34 where much of the backpack load is exerted. As can be seen in FIG. 7, the air-filled nature of the bladders 20, 22 enable the bladders 20, 22 to conform and contour substantially completely to the curvature of the backbone and back, and thereby promote more even load distributions.

Figure 3:
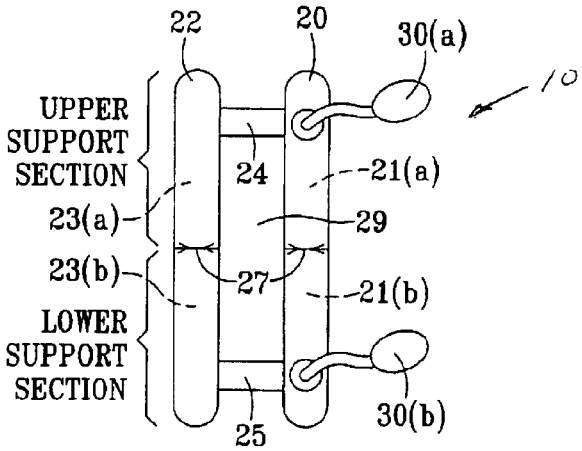
FIG. 3 is a front elevational view of a second preferred embodiment of the back support apparatus having upper and lower support sections which are independently inflatable.

As can be seen in FIG. 3, the pair of elongated, inflatable bladders 20, 22 may each comprise more than one inflation chamber. As shown in FIG. 3 in particular, the right bladder 22 comprises an upper inflation chamber 23*a* and a lower inflation chamber 23*b*. The two inflation chambers 23*a* and 23*b* are divided by means of chamber divider 27 which is preferably a heat-sealed segment of the bladder body. Similarly, the left bladder 20 has an upper inflation chamber 21*a* and a lower inflation chamber 21*b* also formed by means of a chamber divider 27. Furthermore, a top bridge conduit 24 communicably connects the upper inflation chamber 23*a* of the right bladder 22 with the upper inflation chamber 21*a* of the left bladder 20. And as shown in FIG. 3, an upper pump 30*a* is connected to the left bladder 20. The upper inflation chambers 23*a* and 21*a*, together with the top bridge conduit 24 define an upper support section which contacts an upper section of the user's back. This arrangement enables the inflation of the upper support section only. Similarly, a bottom bridge conduit 25 communicably connects the lower inflation chamber 23*b* of the right bladder 22 with the lower inflation chamber 21*b* of the left bladder 20. Furthermore, with the attachment of a bulb pump 30*b*, a lower support section is created which may be independently inflated and deflated from the upper support section.

Figure 4:
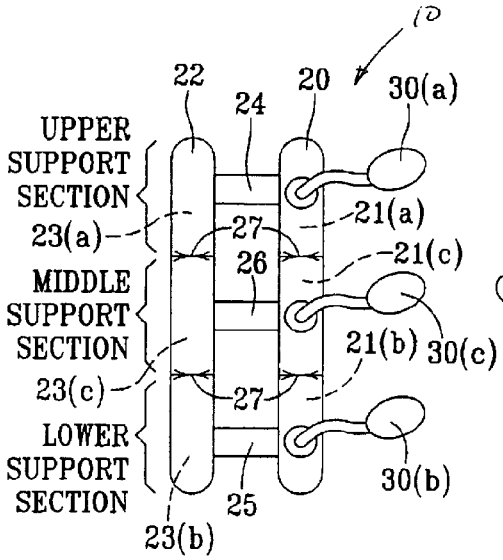
FIG. 4 is a front elevational view of a third preferred embodiment of the back support apparatus having upper, middle, and lower support sections which are independently inflatable.

The concept of providing separate support sections is further illustrated in FIG. 4 comprising a third and middle support section between the upper and lower support sections and sectioned off by means of chamber dividers 27. The middle support section comprises a middle inflation chamber 23*c* of the right bladder 22 and a middle inflation chamber 21*c* of the left bladder 20. The middle inflation chambers 21*c* and 23*c* are communicably connected by a middle bridge conduit 26 which enables air flow between the two middle inflation chambers 21*c* and 23*c*. With the addition of a bulb pump 30*c*, the middle support section may be independently inflated and deflated from the upper support section and lower support section. It is notable that the concept of having multiple support sections as shown in FIGS. 3 and 4 may be further extended to multiple support sections greater than three.

Figure 5:
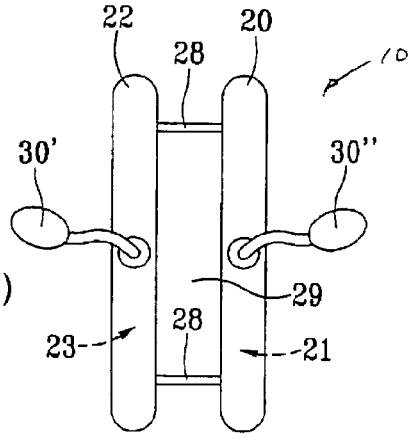
FIG. 5 is a front elevational view of a fourth preferred embodiment of the back support apparatus having left and right bladders which are independently inflatable.

Finally, in FIG. 5, a fourth embodiment of the bladder support apparatus is shown without the use of bridge conduits which enable communication of air between the bladders 20, 22. In FIG. 5, the two elongated bladders, 20, 22 are structurally supported by a non-communicating connector limb 28, which merely functions to maintain the gap spacing 29 therebetween and maintain the parallel orientation of the bladders. In this preferred embodiment, the left bladder 20 has a bulb pump 30" and the right bladder 22 has a bulb pump 30' such that the left bladder 20 may be independently inflated and deflated from the right bladder 22. This concept of providing separate and independent inflation capability of the left and right inflation chambers can be further extended where each bladder 20, 22 has multiple inflation chambers (example not shown).

In this manner, by enabling independent control of the inflation level of each inflation chamber, various points along a user's back can be targeted to provide optimal comfort and cushioned support as required by the unique needs of the individual.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A backpack system for reinforceably supporting a user's back, said backpack having a front panel comprising a back-facing surface supporting a right and a left shoulder strap, extending downwardly from a right and a left upper attachment point, said backpack system comprising:

a backpack having a front panel;

a pair of elongated inflatable vertically oriented bladders spaced generally parallel to each other and separated by a gap space, said vertically oriented bladders being positioned so that said gap space overlies a vertical central axis of said front panel, said vertically oriented bladders each having an upper terminus extending upwardly at least as high as said right and left upper attachment point and the gap space being aligned over the user's spinal column said pair of elongated inflatable vertically oriented bladders each having a lower terminus and a midpoint halfway between said upper terminus and said lower terminus;

means for vertically connecting said pair of vertically oriented bladders to the front panel of said backpack to provide cushioned back support on opposite sides of a user's spinal column along at least a thoracic region thereof when said backpack is carried on the user's back;

an upper bridge conduit positioned between said pair of vertically oriented bladders conducting air between said bladders, said upper bridge conduit being positioned between said upper terminus and said midpoint;

a lower bridge conduit positioned between said pair of vertically oriented bladders conducting air between said bladders, said lower bridge conduit being positioned between said lower terminus and said midpoint;

means for inflating said pair of vertically oriented bladders; and means for deflating said pair of vertically oriented bladders.

2. The back support apparatus as in claim 1, wherein said pair of vertically oriented bladders are spaced at most two inches from each other.

3. The back support apparatus as in claim 1, wherein said pair of vertically oriented bladders are spaced to exert a support force against the user's spinal column from opposite sides thereof when said backpack is carried on the user's back.

4. The back support apparatus as in claim 1, wherein each vertically oriented bladder has an inflated diameter of at most two inches.

5. The back support apparatus as in claim 1, wherein the upper and lower bridge conduits have an inflated diameter less than an inflated diameter of each vertically oriented bladder.

6. The back support apparatus as in claim 1, wherein said means for vertically connecting said pair of vertically oriented bladders to the front panel of said backpack includes a second panel connected to said front panel to form an interstitial volume therebetween, said interstitial volume for retainably receiving said pair of vertically oriented bladders therein.

* * * * *